US006330014B1

(12) United States Patent
Arauchi et al.

(10) Patent No.: US 6,330,014 B1
(45) Date of Patent: Dec. 11, 2001

(54) THERMAL HEAD MANUFACTURED BY SEQUENTIALLY LAMINATING CONDUCTIVE LAYER, LAYER INSULATING LAYER AND HEATER ELEMENT ON HEAT INSULATING LAYER

(75) Inventors: Susumu Arauchi; Hirotoshi Terao, both of Iwate-Ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/543,928

(22) Filed: Apr. 6, 2000

(30) Foreign Application Priority Data

Apr. 9, 1999 (JP) ..... 11-103161
Jun. 17, 1999 (JP) ..... 11-171345

(51) Int. Cl.[7] ..... B41J 2/345; B41J 2/335
(52) U.S. Cl. ..... 347/208
(58) Field of Search ..... 347/208, 200

(56) References Cited

FOREIGN PATENT DOCUMENTS 06 106758 4/1994 (JP) .
09 123504 5/1997 (JP) .
10 034991 2/1998 (JP) .
10 100460 4/1998 (JP) .
11-314391 11/1999 (JP) .

*Primary Examiner*—Huan Tran
(74) *Attorney, Agent, or Firm*—Brinks Hofer Gilson & Lione

(57) ABSTRACT

The object of the present invention is to provide a thermal head wherein a satisfactory image free of unevenness in printing density can be acquired by suitably correcting voltage drop in the common electrode of the thermal head and heating an individual heater element at uniform temperature. The thermal head according to the invention is characterized in that a common electrode comprised of a conductive layer and a base electrode layer is formed on most of the surface of a heat insulating layer, a separate electrode and a heater element are provided on the common electrode via a layer insulating layer and the edge of the base electrode layer is suitably overlapped with the conductive layer. Also, the thermal head according to the invention is characterized in that the conductive layer is divided every heater element and suitable electric resistance is applied to divided each conductive layer.

12 Claims, 8 Drawing Sheets

THERMAL HEAD MANUFACTURED BY SEQUENTIALLY LAMINATING CONDUCTIVE LAYER, LAYER INSULATING LAYER AND HEATER ELEMENT ON HEAT INSULATING LAYER

BACKGROUND OF THE INVENTION

1. Field of the Invention

The present invention relates to a thermal head, particularly relates to a thermal head wherein a conductive layer electrically connected to a common electrode is formed on a heat insulating layer and a heater element is laminated on the conductive layer via a layer insulating layer.

2. Description of the Prior Art

Heretofore, a general thermal head as a recording head mounted in a thermal printer and others records on thermosensitive recording paper in colors by arraying plural heater elements composed of a heating resistor in one or plural columns on a substrate and selectively energizing and heating each heater element according to record information or prints on various record media by melting ink of an ink ribbon and transferring it on a record medium such as plain paper and paper for an overhead projector (OHP).

Such a conventional type thermal head is provided with a substrate 124 made of a ceramic or silicon and others and having an insulating layer as shown in FIGS. 24 and 25, and a convex portion 124*a* the section of which is approximately trapezoidal is formed in the vicinity of the right end of the upper surface of the substrate 124 shown in FIG. 25.

Also, a heat insulating layer 125 is formed on the upper surface of the substrate 124 and plural heater elements 126 formed in a desired pattern by executing plasma etching by gas acquired by mixing fluoric gas and gaseous oxygen after a heating resistor made of cermet such as Ta—$SiO_2$ is formed by sputtering and others and hereby, arrayed in a row according to the number of dots corresponding to desired resolution are provided on the upper surface of the heat insulating layer 125 on the convex portion 124*a*.

Further, a common electrode 127 is formed on the right side of each heater element 126 shown in FIG. 25 and is formed in a U shape along the outside margin of a thermal head 123 as shown in FIG. 24.

A common electrode terminal 127*a* is formed at two ends of the right and left outside margins of the common electrode 127. A terminal plating layer 127*b* is applied to the upper surface of the common electrode terminal 127*a*.

In the meantime, plural separate electrodes 128 for independently energizing each heater element 126 are patterned above the left side of the heater element 126 shown in FIG. 25. A connecting electrode 129 on the separate electrode side for electrically connecting the separate electrode 128 and the heater element 126 is formed between the separate electrode 128 and the heater element 126. The left end of the separate electrode 128 shown in FIG. 25 is equivalent to a separate electrode terminal 128*a* and a terminal plating layer 128*b* is applied to the upper surface of the separate electrode terminal 128*a*.

The common electrode 127 and the separate electrode 128 are made of Al or Cu and others, are formed in a predetermined pattern by etching and others after Al or Cu is deposited on the upper surface of the heater element 126 and the heat insulating layer 125 by sputtering and others until Al or Cu is approximately 2 $\mu$m thick, and a part between the common electrode 127 and the separate electrode 128 of each heater element 126 is equivalent to a heating part 126*a*.

Also, a passivation layer 130 for preventing oxidation and abrasion is formed on/over the upper surface of the heat insulating layer 125, the heater element 126, the common electrode 127 and the separate electrode 128. The passivation layer 130 is made of SIALON (Si—Al—O—N compound solid solution) excellent in oxidation resistance and abrasion resistance and is laminated by sputtering so that any upper surface except the separate electrode terminal 128*a* and the common electrode terminal 127*a* is coated.

In the conventional type thermal head 123 having configuration described above, predetermined recording is performed by selectively heating the heater element 126 by selectively energizing between the common electrode 127 and the separate electrode 128, melting ink of an ink ribbon touched to the part and transferring it on recording paper or directly coloring thermosensitive recording paper.

Also, in the conventional type thermal head 123, as described above, the convex heat insulating layer 125 is provided near to the end of the substrate 124 with the layer biased, the heating part 126*a* is formed on the convex heat insulating layer 125 and the quality of recording is enhanced by using such a thermal head 123.

However, the conventional type thermal head 123 has a problem that as the common electrode 127 is extremely elongated in a narrow part between the end of the substrate 124 and the heater element 126 because the respective heater elements 126 are formed near the end of the substrate 124 as shown in FIG. 24, the resistance value of the electrode is increased even if the common electrode 127 is made of copper or aluminum, so-called voltage drop occurs in the common electrode 127 and dispersion occurs in exoergic temperature among the heater elements 126.

Further, the length of an energizing path from the heater element 126 to the common electrode terminal 127*a* differs every heater element 126 and the heater element 126 near the center of the row is the farthest from the common electrode terminal 127*a*. Therefore, the quantity of voltage drop in the common electrode 127 connected to the heater element 126 near the center of the row is increased and the exoergic temperature of the heater element 126 near the center of the row sometimes lowers.

In thermal imprint printing for example when voltage drop occurs in such a thermal head and the exoergic temperature of the heater element 126 lowers, there is a problem that the quality of printing is deteriorated such as the unevenness of density in printing is increased.

For a countermeasure against voltage drop, it is conceivable to reduce the quantity of voltage drop by thickening the thickness of the common electrode 127, however, when the thickness of the common electrode 127 is thickened, it becomes difficult to laminate the passivation layer 130 on the common electrode 127, in addition, in printing, the pressure of the thermal head 123 and a platen of a printer not shown concentrates at the heating part 126*a* and the common electrode 127 adjacent to the heating part 126*a* and large shearing stress is applied to the common electrode 127.

Therefore, there is a defect that material fatigue (metal fatigue) occurs in the common electrode 127 made of soft metallic material such as Al and Cu, the passivation layer 130 is peeled or destroyed early, disconnection due to abrasion and corrosion occurs in the common electrode 127 and the life is short.

Also, voltage drop is inhibited and the difference of exoergic temperature in the position of each heater element 126 can be removed by using a well-known thermal head called an alternate lead head adjacent to the row of each heater element 126 and provided with plural adjacent common electrodes, however, in this case, there is also a defect that as the adjacent common electrode is formed between adjacent heater elements, a dimension between heater elements is increased, a dimension between dots of a printed image is increased and high definition printing is difficult.

SUMMARY OF THE INVENTION

The object of the invention is to provide a thermal head wherein voltage drop in a common electrode of the thermal head is properly corrected, a separate heater element is heated at uniform temperature and a satisfactory image free of unevenness in printing density can be acquired.

That is, the thermal head according to the invention is characterized in that it is provided with a heat insulating layer formed on the upper surface of a substrate, plural heater elements formed in a row over the heat insulating layer, plural separate electrodes respectively electrically connected to one and the other of the plural heater elements, and a common electrode, the common electrode is composed of a base electrode layer connected to a common electrode terminal provided on both outsides of the sequence of the separate electrodes and a conductive layer connected to the base electrode layer and formed on the side of the heat element, the common electrode is formed on the surface of most of the heat insulating layer, a layer insulating layer for electrically insulating the common electrode and the separate electrode is formed on the common electrode, the separate electrode and the heater element are formed on the layer insulating layer and the edge of the base electrode layer is provided opposite to the edge of the heater element in a direction of the surface of the substrate.

The object of the invention is to increase the area of the common electrode from the common electrode terminal to the heater element, to inhibit voltage drop in the common electrode and to uniformly heat each heater element and acquire a satisfactory printed image free of unevenness in printing density.

Further, the thermal head according to the invention is characterized in that the edge of the base electrode layer opposed to the heater element is linearly formed in parallel to the row of the heater elements.

The object of the invention is to effectively reduce the electrical resistance of the common electrode and to suitably inhibit voltage drop in the common electrode.

Further, the thermal head according to the invention is characterized in that the edge opposed to the heater element of the base electrode layer is put close to the side of the heater element in the vicinity of the center of the row of the heater elements.

The object of the invention is to reduce distance from the edge of the base electrode layer to the vicinity of the center of the row of the heater elements and to suitably inhibit voltage drop in the common electrode.

Also, further, the thermal head according to the invention is characterized in that the edge of the base electrode layer is protruded in a triangle or in an arc.

The object of the invention is to facilitate protrusion to put the edge of the base electrode layer close to the side of the heater element.

Also, the thermal head according to the invention is characterized in that the edge opposed to the heater element of the base electrode layer is put far from the heater element in the vicinity of the center of the row of the heater elements.

The object of the invention is to reduce heat reserve in the vicinity of the center of the row of the heater elements and to enable high quality of printing even if continuous printing is executed for a long time.

Further, the thermal head according to the invention is characterized in that the edge of the base electrode layer is formed in a triangle or with the edge concave in an arc.

The object of the invention is to hollow the edge of the base electrode layer so that it is put far from the heater element.

Also, the thermal head according to the invention is characterized in that it is provided with a heat insulating layer formed on the upper surface of a substrate, plural heater elements formed in a row over the heat insulating layer and plural separate electrodes electrically connected to one of the heater element, plural conductive layers formed in parallel in the same direction as the separate electrode are provided on the upper surface of the heat insulating layer under the separate electrodes, a layer insulating layer for insulating the conductive layer and the separate electrode is provided between the separate electrode and the conductive layer, the conductive layer is formed so that the resistance value of the conductive layer on the side of the end is larger than that of the conductive layer in the vicinity of the center of the row of the heater elements and a base electrode layer and the heater element are respectively electrically connected to one and the other of the conductive layer and the heater element is energized.

The object of the invention is to correct voltage drop in the conductive layer, to apply constant voltage to each heater element, to heat each heater element at uniform temperature and to acquire a satisfactory printed image free of unevenness in printing density.

Further, the thermal head according to the invention is characterized in that the conductive layer is composed of a pair of good conductors mutually opposite with clearance having a predetermined dimension between them and a resistor formed in the clearance and the resistance value of the conductive layer on the side of the end is increased, compared with that in the vicinity of the center by differentiating the length of the clearance.

The object of the invention is to correct voltage drop in the conductive layer and to uniform the heat of each heater element in the vicinity of the center of the row of the heater elements and on the side of the end.

Furthermore, the thermal head according to the invention is characterized in that the clearance is extended from the vicinity of the center to the side of the end.

The object of the invention is to sequentially increase the resistance value of the conductive layer from the vicinity of the center of the row of the heater elements to the side of the end and to further securely correct voltage drop in the conductive layer.

Also, the thermal head according to the invention is characterized in that the conductive layer is provided with plural groups of good conductors each of which is composed of adjacent plural good conductors on the side of the end and adjacent plural good conductors in the group of good conductors are connected via the resistor.

The object of the invention is to facilitate the manufacture by collecting adjacent plural good conductors and forming a resistor with every group of collected good conductors.

Further, the thermal head according to the invention is characterized in that plural groups of good conductors are formed from the vicinity of the center to the side of the end, in each group of good conductors, the length of the clearance between good conductors is equalized and the clearance between groups of good conductors is elongated from the vicinity of the center to the side of the end.

The object of the invention is to facilitate the manufacture without forming a resistor every conductive layer.

Also, the thermal head according to the invention is characterized in that the conductive layer on the side of the end is composed of a narrow part and a wide part and the resistance value of the conductive layer on the side of the end is increased, compared with that in the vicinity of the center by differentiating the length of the narrow part.

The object of the invention is to facilitate the manufacture without forming a resistor on the conductive layer.

Further, the thermal head according to the invention is characterized in that the narrow part is elongated from the vicinity of the center to the side of the end.

The object of the invention is to sequentially increase the resistance value of the conductive layer from the vicinity of the center of the row of the heater elements to the side of the end and to further securely correct voltage drop in the conductive layer.

DETAILED DESCRIPTION OF THE PREFERRED EMBODIMENTS

Figure 1:
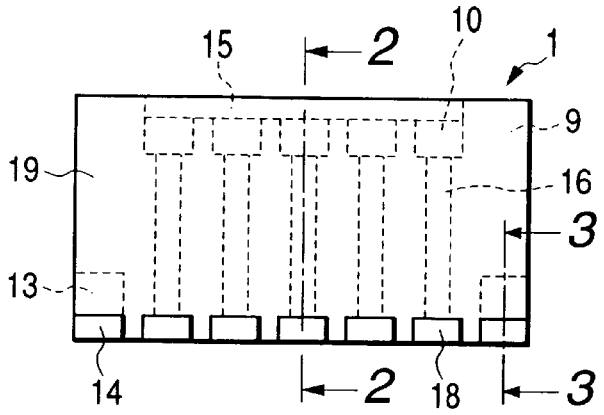
FIG. 1 is a plan showing an embodiment of a thermal head according to the invention.
Figure 2:
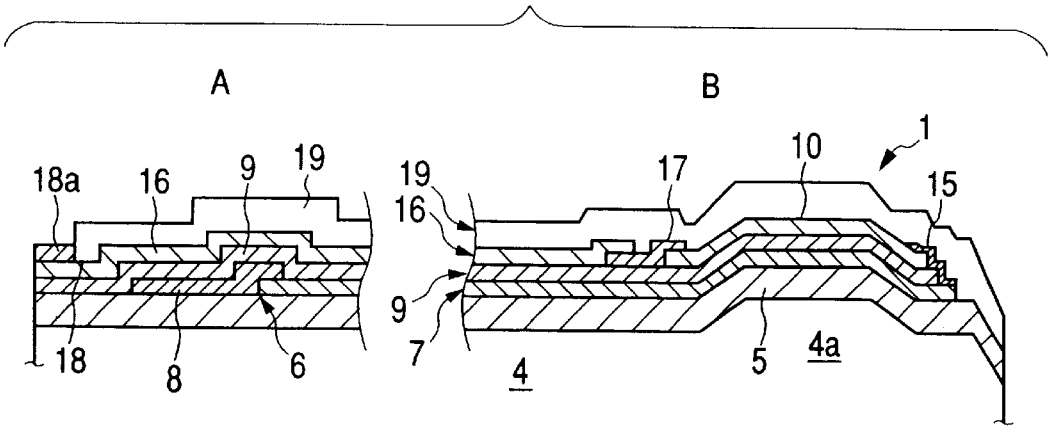
FIGS. 2A and 2B are sectional views showing the thermal head viewed along a line 2—2 in FIG. 1.
Figure 3:
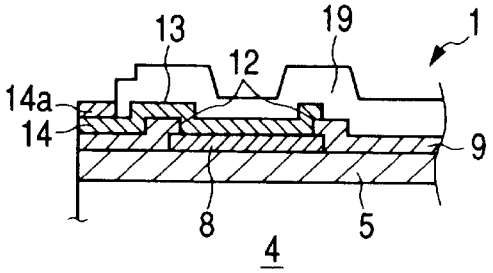
FIG. 3 is a sectional view showing the thermal head viewed along a line 3—3 in FIG. 1.

Referring to FIGS. 1 to 9, an embodiment of the invention will be described below. FIGS. 1 to 3 are schematic drawings for explaining a thermal head according to the invention, FIGS. 4 to 8 are schematic drawings for explaining a manufacturing method according to the invention and FIGS. 9 to 13 are schematic drawings showing other embodiments of the invention.

In FIG. 1, a thermal head 1 provided with heater elements 10 for five dots extremely smaller in the number for the convenience of explanation, compared with the actual number is shown as an example.

First, the thermal head 1 equivalent to an embodiment of the invention is provided with an approximately flat substrate 4 on the lower side as shown in FIG. 2. A convex portion 4*a* having an approximately trapezoidal section is formed in the vicinity of the right end of the substrate 4 as shown in FIG. 2B.

A heat insulating layer 5 is formed on the upper surface of the substrate 4. The heat insulating layer 5 is mainly made of high melting point glass as heretofore.

A common electrode 6 is formed on the upper surface of the heat insulating layer 5. The common electrode 6 is formed in a range from the end (hereinafter called the end on the side of the heater element) on the side where the heater element 10 shown in FIG. 2B is formed to the vicinity of the end (hereinafter called the end on the side of an electrode terminal) on the side where a common electrode terminal 14 shown in FIG. 3 and a separate electrode terminal 18 shown in FIG. 2A are formed via over the convex portion 4*a*.

Also, the common electrode 6 is composed of the common electrode terminal 14 placed side by side with plural separate electrodes 16 described later formed in parallel and formed on both outsides of the separate electrodes 16, a base electrode layer 8 connected to the common electrode terminal 14 and a conductive layer 7 formed on the side of the heater element 10 described later and connected to the base electrode layer 8. The base electrode layer 8 and the conductive layer 7 occupy most of the surface of the heat insulating layer 5.

The conductive layer 7 is formed so that it has uniform thickness in a range from the end on the side of the heater element before the end on the side of the electrode terminal on the upper surface of the heat insulating layer 5 as shown in FIG. 2. The conductive layer 7 is formed thinly to reduce an effect upon a temperature dependence characteristic and it is desirable that the conductive layer has the thickness of approximately 0.15 μm. Also, as the conductive layer 7 is arranged under the heater element 10 that emits high temperature, it is formed by high melting point metal not melted and not damaged by the exoergic temperature of the heater element 10 such as Cr, Mo, Ti, Zr, Ta, Nb, W and Hf respectively having the melting point of 1500° C. or higher. Further, the width of the conductive layer 7 in a direction in which the heater elements 10 are arrayed (in a lateral direction in FIG. 1) is formed so that it is slightly wider than the width of the row of the heater elements 10 as shown in FIG. 8.

Figure 8:
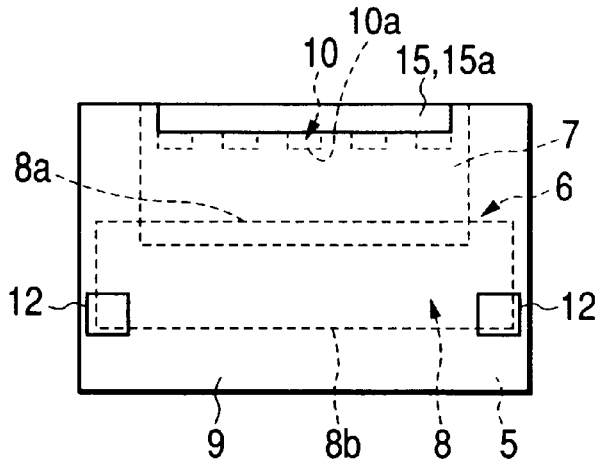
FIG. 8 is a schematic drawing for explaining the method of manufacturing the thermal head according to the invention.

Also, the base electrode layer 8 is formed rectangularly having an edge 8*a* which is the front end and a rear edge 8*b* respectively formed linearly as shown in FIG. 8, the edge 8*a* is laminated on the edge of the conductive layer 7, and the conductive layer 7 and the base electrode layer 8 are electrically connected.

The base electrode layer 8 is formed on the upper surface of the heat insulating layer 5 in a range including a terminal connection 12.

Also, the linear edge 8*a* of the base electrode layer 8 is opposed to the respective edges 10*a* of the plural heater elements 10 in a horizontal direction via a layer insulating layer 9 described later as shown in FIG. 8.

The base electrode layer 8 is formed by metal having low resistivity and it is desirable that the base electrode layer is formed by metal having the resistivity of $1\times10^{-7}$ Ωm or lower such as Al, Cu, Au and Ni so that the thickness is approximately 1.0 to 3.0 μm and is thicker than that of the conductive layer 7. The width in a lateral direction shown in FIG. 8 of the base electrode layer 8 is formed so that it is wider than that of the conductive layer 7 in the same direction, the base electrode layer 8 is formed up to the terminal connection 12 formed along each end face of both right and left sides of the substrate 4 and is connected to the common electrode terminal 14 described later.

A layer insulating layer 9 is formed on the upper surface of the conductive layer 7 and the base electrode layer 8. The layer insulating layer 9 is formed by the oxide of silicon or nitrogen oxide to secure insulation so that the thickness is approximately 1.5 μm.

The heater element 10 made of Ta—$SiO_2$ is laminated in a position corresponding to the convex portion 4*a* on the upper surface of the layer insulating layer 9. The heater elements 10 are connected to a connecting electrode 15 shown in FIG. 1 according to the number of dots corresponding to the desired resolution of the thermal head 1 and the size and are arrayed in a lateral direction.

The connecting electrode 15 is formed by conductive high melting point metal material such as Mo, Cr and Ti on the upper surface of the conductive layer 7 exposed from the end on the side of the heater element of the layer insulating layer 9.

One end of the connecting electrode 15 is connected to the conductive layer 7 of the common electrode 6 on the lower side, the other end is connected to the heater element 10 on the upper side, and the conductive layer 7 and the heater element 10 are electrically connected with the layer insulating layer 9 between them.

A range in the lateral direction shown in FIG. 8 in which the connecting electrode 15 is formed is substantially equal to a range in the same direction in which the conductive layer 7 is formed.

Further, the terminal connection 12 shown in FIG. 3 is laminated on the base electrode layer 8 on the side of the common electrode terminal of the layer insulating layer 9, placed side by side with plural separate electrodes 16 described later formed in parallel and on both outsides of the separate electrodes 16. A side electrode 13 made of conductive satisfactory metal such as Al is formed on the upper surface of the base electrode layer 8 exposed by the terminal connection 12.

The left end shown in FIG. 3 of the side electrode 13 is equivalent to the common electrode terminal 14, a terminal plating layer 14*a* is applied on the common electrode terminal 14 and the terminal plating layer 14*a* is exposed from the passivation layer 19 described later.

Therefore, the base electrode layer 8 and the common electrode terminal 14 are electrically connected by the terminal connection 12.

As described above, the common electrode 6 is formed on the surface of most of the heat insulating layer 5, however, the common electrode is not limited to this and has only to be in such a shape as a conductive path on which distance between each heater element 10 and the common electrode terminal 14 is substantially uniform is formed.

The separate electrodes 16 made of conductive satisfactory metal such as Al and Cu are formed in a range on the upper surface of the layer insulating layer 9 from the vicinity of the left end of the heater elements 10 shown in FIG. 2B to the left end shown in FIG. 2A.

The separate electrodes 16 are respectively electrically connected to the heater elements 10 via a connecting electrode on the separate electrode side 17 made of high melting point metal such as Mo, Cr and Ti. Further, the left end shown in FIG. 2A of the separate electrodes 16 is equivalent to the separate electrode terminal 18. The terminal plating layer 18*a* is applied on the separate electrode terminal 18 and is exposed from the passivation layer 19.

The passivation layer 19 for protecting the heater element 10, the separate electrode 16, the connecting electrode 15, the connecting electrode on the separate electrode side 17, the layer insulating layer 9, the side electrode 13, the conductive layer 7 and the heat insulating layer 5 from oxidation or abrasion is formed on/over them. The passivation layer 19 is made of SIALON (Si—Al—O—N compound solid solution) satisfactory in oxidation resistance and abrasion resistance or Si—O—N compound and others.

Next, referring to FIGS. 4 to 8, a method of manufacturing the thermal head 1 according to the invention will be described.

In the method of manufacturing the thermal head 1 equivalent to the embodiment of the invention, plural thermal heads 1 are simultaneously formed on one large substrate 4 as heretofore though it is not shown and the plural thermal heads 1 can be simultaneously acquired by dividing the large substrate 4 in desired positions.

Figure 4:
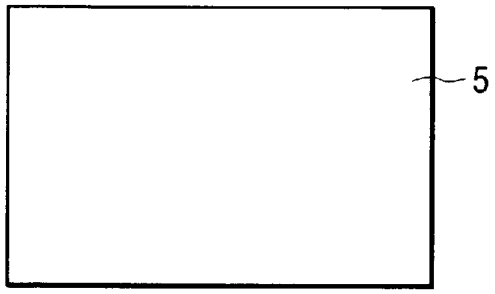
FIG. 4 is a schematic drawing for explaining a method of manufacturing the thermal head according to the invention.

In such a method of manufacturing the thermal head 1, first in a process for forming a substrate, silicon formed flatly is etched as heretofore to form a substrate 4 having a convex portion 4*a*, next in a process for forming a heat insulating layer, a heat insulating layer 5 having approximately similar thickness shown in FIG. 4 made of the oxide of silicon, transition metals and oxygen is formed on the upper surface of the substrate 4 as heretofore.

Figure 5:
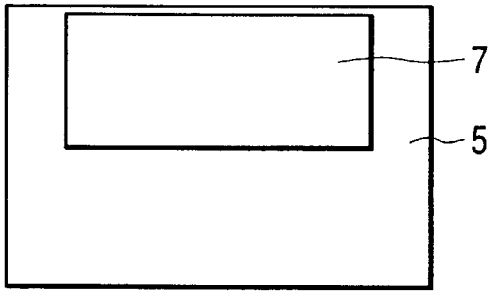
FIG. 5 is a schematic drawing for explaining the method of manufacturing the thermal head according to the invention.

Next, first in a process for forming a conductive layer in a process for forming a common electrode, after high melting point metal having the melting point of 1500° C. or higher such as Cr, Mo, Ti, Zr, Ta, No, W and Hf is deposited by sputtering and others until the metal has the uniform thickness of approximately 0.15 μm on/over the substrate 4 and the heat insulating layer 5, the conductive layer 7 having a substantially rectangular shape shown in FIG. 5 as a part of a common electrode 6 of a desired pattern is formed by etching. At this time, as an unnecessary short circuit is prevented by forming the peripheral edge of the conductive layer 7 so that it is smaller than the peripheral edge of the substrate 4, it is desirable.

Figure 6:
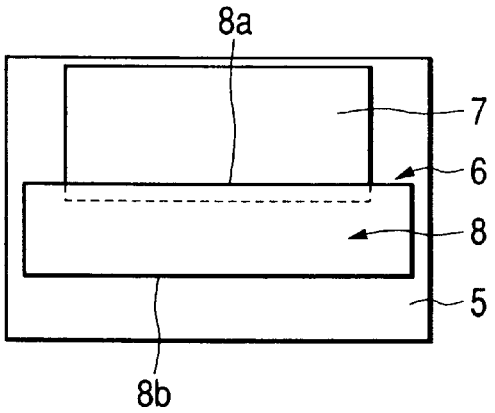
FIG. 6 is a schematic drawing for explaining the method of manufacturing the thermal head according to the invention.

Next, in a process for forming a base electrode layer included in the process for forming the common electrode, after metal satisfactory in conductivity having the resistivity of $1\times10^{-7}$ Ωm or lower such as Al, Cu, Au and Ni is deposited on the heat insulating layer 5 and as a part of the conductive layer 7 by sputtering and others until the metal has the uniform thickness of approximately 1 to 3 μm, the base electrode layer 8 shown in FIG. 6 as a part of the common electrode 6 is formed by etching.

As for the base electrode layer 8, the shape having the upper edge 8*a* on the front side shown in FIG. 6 and the lower rear edge 8*b* is formed in a rectangle and the width in the lateral direction is formed so that it is wider than the width of the conductive layer 7.

Next, in a process for forming a layer insulating layer, the layer insulating layer 9 having a connection on a common electrode side 15*a* and a terminal connection 12 is formed on the upper surface of the conductive layer 7 and the base electrode layer 8.

Figure 7:
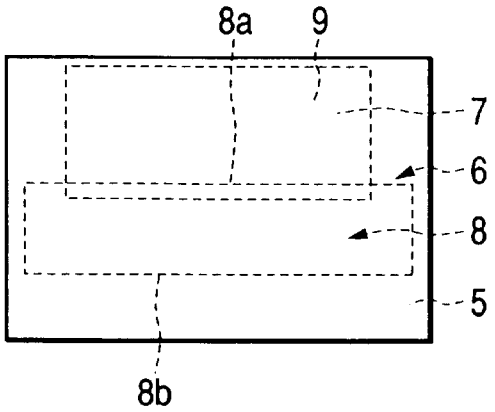
FIG. 7 is a schematic drawing for explaining the method of manufacturing the thermal head according to the invention.

To explain the process for forming the layer insulating layer further detailedly, first, in a film forming process, material such as $SiO_2$ or Si—O—N compound is deposited on the overall upper surface of the common electrode 6 composed of the conductive layer 7 and the base electrode layer 8 by well-known sputtering or CVD and others until the material has the uniform thickness of approximately 1 to 3 μm so as to form the layer insulating layer 9 shown in FIG. 7.

Next, in an etching process, after photoresist is applied to the overall upper surface of the layer insulating layer 9 by a spinner and others to form a resist film, the layer insulating layer 9 is etched using buffered hydrofluoric acid (BHF) and others to form the connection on the common electrode side 15*a* and the terminal connection 12 shown in FIG. 8 in respective desired positions.

Next, in a process for forming a heater element, after a desired heating resistor made of $Ta_2$ N or Ta—$SiO_2$ and others is formed by sputtering and others as heretofore so that the heating resistor has the uniform thickness of approximately 0.3 μm, etching by photolithography is applied and plural heater elements 10 in a predetermined shape arrayed according to the number of predetermined dots corresponding to resolution are laminated.

At this time, each heater element 10 is insulated from the conductive layer 7 because of the layer insulating layer 9.

Next, in a process for forming a connecting electrode, high melting point metal such as Mo, Cr and Ti is deposited by sputtering and others, and the connecting electrode 15 in a desired pattern for electrically connecting one side of the heater element 10 and the conductive layer 7 is formed by etching and others.

Next, in a process for forming a connecting electrode on the separate electrode side, high melting point metal made of the same material as the connecting electrode 15 is deposited by sputtering and others on the other side of the heater elements 10 and the layer insulating layer 9 in the vicinity of the other side and the connecting electrode on the separate electrode side 17 in a desired pattern for electrically connecting the heater element 10 and a separate electrode 16 formed in a process for forming a separate electrode described later is formed by etching and others.

Next, in a process for forming the separate electrode, after Al and others are deposited on the layer insulating layer 9 by sputtering and others until they have the thickness of approximately 1 to 3 μm for example, the separate electrode 16 in a desired pattern connected to each heater element 10 for independently energizing it is formed on one side (the left side shown in FIG. 2B) of the connecting electrode on the separate electrode side 17.

Next, in a process for forming a side electrode, after metal having satisfactory conductivity such as Al is deposited by sputtering and others until the metal has the uniform thickness of approximately 1 to 3 μm for example, the side electrode 13 in a desired pattern electrically connected to the base electrode layer 8 inside the terminal connection 12 is formed by well-known etching.

Next, in a process for forming a passivation layer, the passivation layer 19 is formed by depositing material such as SIALON (Si—Al—O—N compound solid solution) or Si—O—N compound on a part except the common electrode terminal 14 and the separate electrode terminal 18 by sputtering, CVD and others until the material has the substantially even thickness of approximately 5 to 10 μm for example and next, in a dicing process, the manufacture of the thermal head 1 equivalent to this embodiment is completed by simultaneously acquiring chipped plural thermal heads 1 by dividing the large substrate 4 in each desired position.

A mask layer such a heat-resistant pressure sensitive adhesive tape is applied to the common electrode terminal 14 and the separate electrode terminal 18 when the passivation layer 19 is formed, and the common electrode terminal 14 and the separate electrode terminal 18 are exposed by peeling the mask layer after the passivation layer 19 is formed.

Terminal plating layers 14*a* and 18*a* easy in solderability such as Ni—Sn compound are respectively applied to the upper surface of the common electrode terminal 14 and the separate electrode terminal 18.

Next, to explain the action of the embodiment of the invention using a thermal printer as an example, the thermal head 1 equivalent to the embodiment of the invention having the configuration described above is mounted on a carriage of the thermal printer not shown.

That is, the thermal head 1 equivalent to the embodiment of the invention melts and transfers or sublimates and transfers ink of an ink ribbon on the heater element 10 on recording paper by pressing the ink ribbon of a ribbon cassette installed on the carriage on the recording paper and selectively energizing the heater elements 10 according to record information, moving the carriage and prints a desired image.

To explain further concretely, one end of a cable for energizing not shown is connected to the separate electrode terminal 18 and the common electrode terminal 14 of the thermal head 1 equivalent to the embodiment of the invention and the other end of the cable is connected to an energizing controller not shown in the body of the printer. The energizing controller energizes the separate electrode terminal 18 based upon record information via the cable.

Hereby, first, a signal is transmitted from the separate electrode terminal 18 to the separate electrode 16, the separate electrode 16 energizes the connecting electrode on the separate electrode side 17 and current flows from the connecting electrode on the separate electrode side 17 to the heater element 10. Current flows from the heater element 10 to the conductive layer 7 under the heater element 10 via the connecting electrode 15.

Next, current flows from the conductive layer 7 to the base electrode layer 8. At this time, as the conductive layer 7 is approximately 0.15 μm thick and thin though the conductive layer 7 is located immediately under the heater element 10, an effect upon a temperature dependence characteristic is small and as the conductive layer is made of high melting point metal, energizing is not prevented by the heat of the heater element 10.

Next, the base electrode layer 8 energizes the side electrode 13, however, at this time, as the base electrode layer 8 is made of metal having low resistivity, is 1 to 3 μm thick and slightly thick, conductivity is satisfactory and the base electrode layer 8 energizes the side electrode 13 via the terminal connection 12 in a state in which the energizing resistance of the base electrode layer 8 in a lateral direction in FIG. 1 can be almost ignored.

Current flows to the common electrode terminal 14 via the side electrode 13 and current flows from the common electrode terminal 14 to the side of the printer outside the thermal head 1. Hereby, as control current according to an instruction from the energizing controller on the side of the printer flows from the separate electrode terminal 18 to the common electrode terminal 14 via the heater element 10, Joule heat is generated in the heater element 10 and heats up to predetermined temperature.

Therefore, according to the embodiment of the invention, as the common electrode 6 made of material different from that of the conductive layer 7 and the base electrode layer 8 is formed under the heater element 10 via the layer insulating layer 9, an energizing path between the heater element 10 and the common electrode terminal 14 can be reduced, compared with that in a conventional type, in the base electrode layer 8 satisfactory in conductivity, energizing resistance in a direction of the array in the thermal head 1 shown in FIG. 1 can be substantially ignored, energizing resistance as the whole common electrode 6 can be remarkably reduced, compared with that in a conventional type common electrode and voltage drop (common drop) in the common electrode which has been a problem heretofore can be inhibited.

Hereby, the thermal head 1 according to the invention can energize the heater elements 10 uniformly without being influenced by the length of the energizing path between the common electrode terminal 14 and the heater element 10. Therefore, each heater element 10 can be heated at uniform temperature and when printing is performed using the thermal head 1 according to the invention, a satisfactory printed image free of unevenness in printing density can be acquired.

Figure 9:
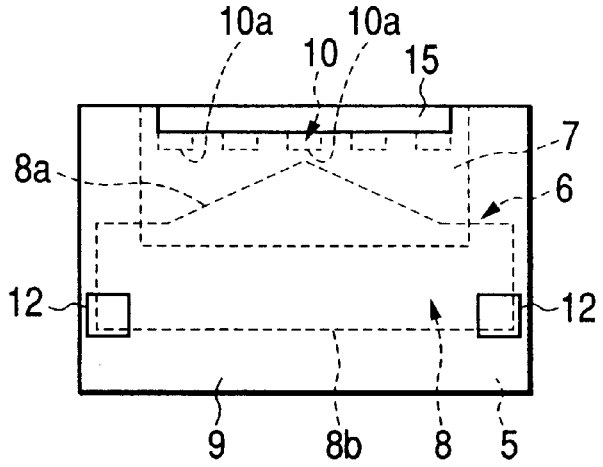
FIG. 9 is a schematic drawing for explaining another embodiment of the invention.
Figure 10:
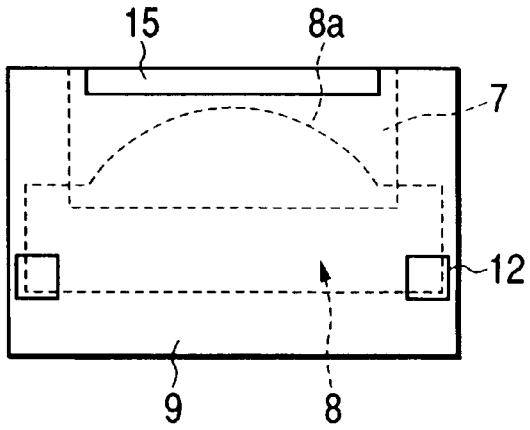
FIG. 10 is a schematic drawing for explaining another embodiment of the invention.

Also, as to the thermal head 1 according to the invention, it is explained that the edge 8*a* of the base electrode layer 8 is linearly formed in parallel to the row of the heater elements 10, however, in such a thermal head 1, the edge 8*a* of the base electrode layer 8 may be also formed in a triangle shown in FIG. 9 or in an arc shown in FIG. 10 so that the edge 8*a* is put close to the vicinity of the center of the row of the heater elements 10 and the edge 8*a* may be also protruded opposite to the edge 10*a* of the heater element 10 via the layer insulating layer 9 in the direction of the surface of the substrate which is a horizontal direction.

In such a thermal head, distance between a base electrode layer 8 and the vicinity of the center of the row of heater elements 10 can be reduced and even if an energizing path between a common electrode terminal 14 and the vicinity of the center of the row of the heater elements 10 is long, the heater elements 10 free of voltage drop in the vicinity of the center of the row of the heater elements 10 can be uniformly energized.

Figure 11:
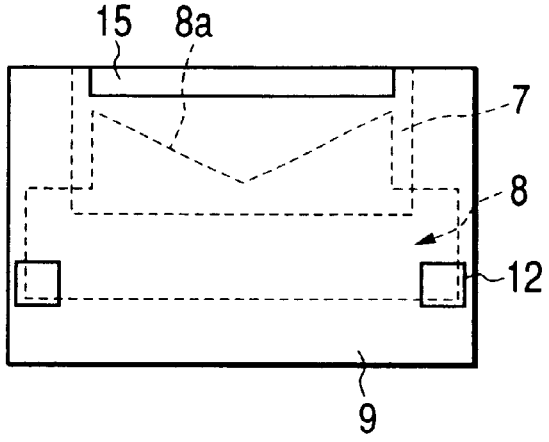
FIG. 11 is a schematic drawing for explaining another embodiment of the invention.
Figure 12:
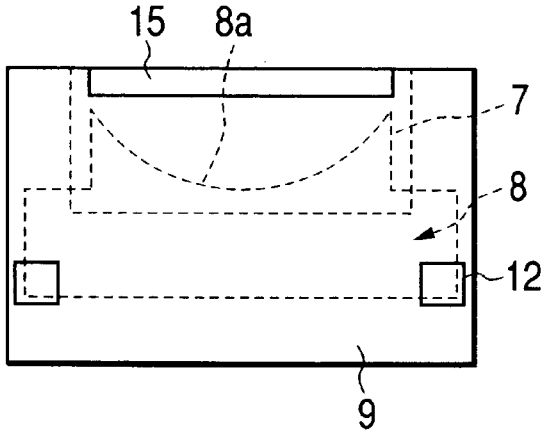
FIG. 12 is a schematic drawing for explaining another embodiment of the invention.

Also, in the case of a thermal head used for a printer for continuously printing for a long time, the edge 8*a* of a base electrode layer 8 is put far from heater elements 10 in the vicinity of the center of the row of the heater elements 10 and may be also made hollow in a triangle shown in FIG. 11 or in an arc shown in FIG. 12. Such a thermal head also enables high quality of printing in continuous printing for a long time because the heat reserve of a substrate in the vicinity of the center of the row of the heater elements 10 is small.

Figure 13:
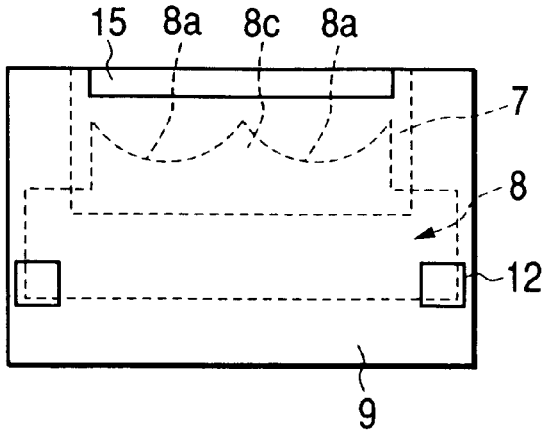
FIG. 13 is a schematic drawing for explaining another embodiment of the invention.

Also, a thermal head shown in FIG. 13 wherein the edge 8*a* of a base electrode layer 8 is protruded so that a part opposite to the vicinity of the center of the row of the heater elements 10 is put close to the heater elements, a projection 8*c* is formed and each edge 8*a* on both sides of the projection 8*c* is made hollow in an arc may be also used for a thermal head wherein voltage drop in the vicinity of the center of the row of heater elements 10 is prevented and the heat reserve of a substrate in the vicinity of the center of the row of the heater elements can be also reduced in continuous printing for a long time.

Figure 14:
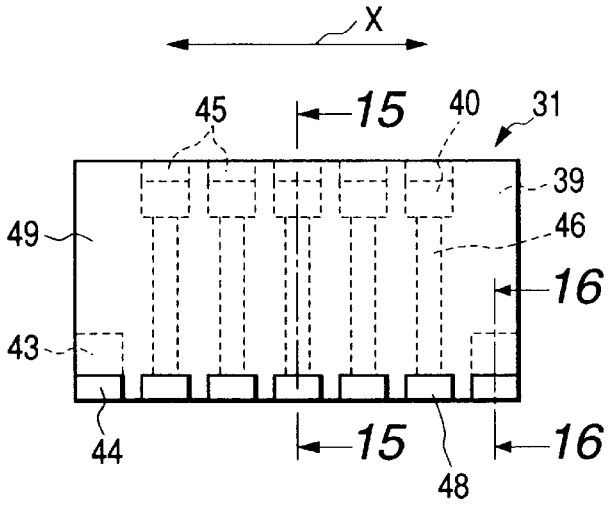
FIG. 14 is a plan showing another embodiment of the thermal head according to the invention.
Figure 15:
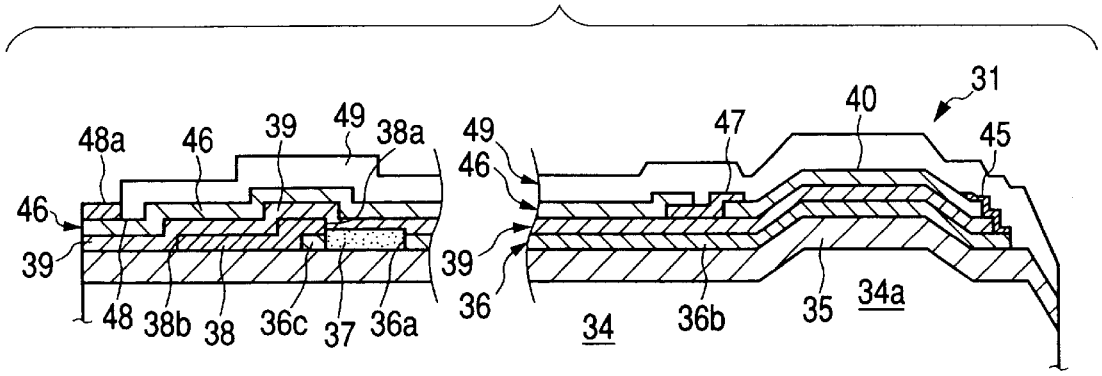
FIG. 15 is a sectional view viewed along a line 15—15 in FIG. 14.
Figure 16:
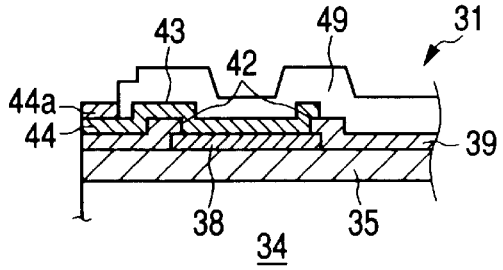
FIG. 16 is a sectional view viewed along a line 16—16 in FIG. 14.
Figure 22:
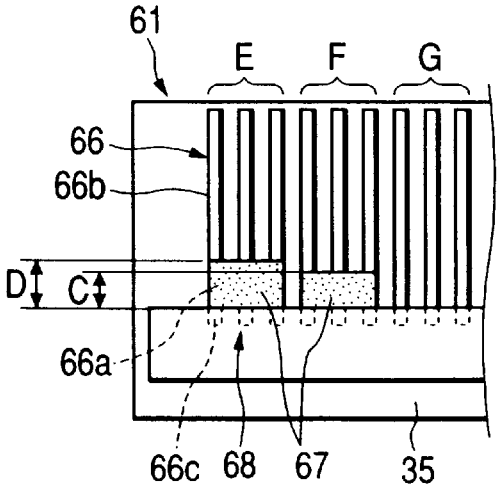
FIG. 22 is a plan showing another embodiment of the thermal head according to the invention.
Figure 23:
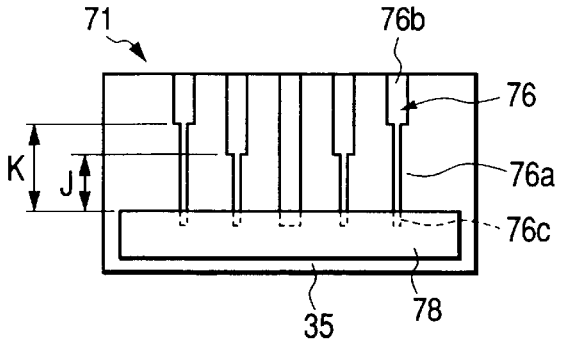
FIG. 23 is a plan showing the other embodiment of the thermal head according to the invention.
Figure 24:
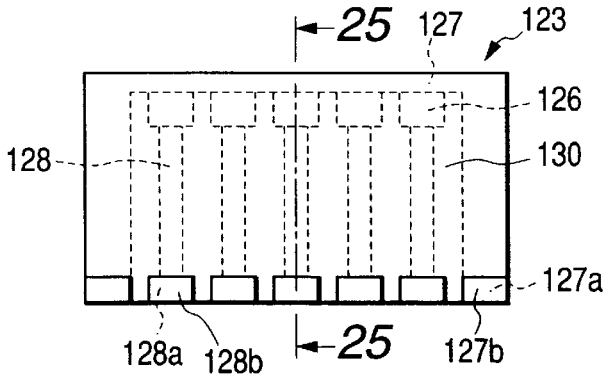
FIG. 24 PRIOR ART
FIG. 24 is a plan showing a conventional type thermal head.
Figure 25:
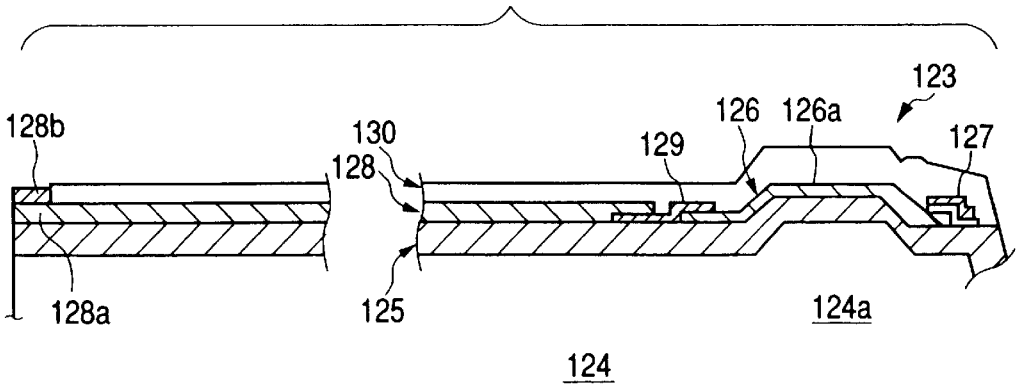
FIG. 25 PRIOR ART
FIG. 25 is a sectional view viewed along a line 25—25 in FIG. 24.

Also, referring to FIGS. 14 to 21, a thermal head equivalent to another embodiment of the invention will be described below. FIGS. 14 to 16 are schematic drawings showing the thermal head equivalent to another embodiment of the invention, FIGS. 17 to 21 are schematic drawings for explaining its manufacturing method, FIG. 22 shows further another embodiment of the invention and FIG. 23 is a schematic drawing showing the other embodiment of the invention.

The respective drawings show a thermal head having heater elements for dots extremely smaller in the number for the convenience of explanation, compared with that in an actual thermal head as an example.

First, a thermal head 1 equivalent to another embodiment of the invention is provided with a heat insulating layer 35 formed on the upper surface of a substrate 34, plural heater elements 40 arrayed in a row over the heat insulating layer 35, plural separate electrodes 46 respectively electrically connected to one and the other of the heater element 40 and a connecting electrode 45 connected to a conductive layer 36 as shown in FIGS. 14 and 15, and plural conductive layers 36 formed in parallel in the same direction as the separate electrode 46 are further provided on the upper surface of the substrate 34 under the separate electrode 46 via a layer insulating layer 39 for electrically insulating from the separate electrode 46.

As for the detailed configuration of the thermal head 1 having the schematic configuration described above, as shown in FIG. 15, the substrate 34 having predetermined thickness is arranged in the lowest part In the substrate 34, a convex portion 34*a* protruded upward having the substantially trapezoidal section is formed in the vicinity of the right end shown in FIG. 15.

Also, the heat insulating layer 35 is formed on the upper surface of the substrate 34. The heat insulating layer 35 is mainly made of high melting point glass as heretofore.

The patterned plural conductive layers 36 arrayed in parallel corresponding to the number of plural heater elements 40 are formed on the upper surface of the heat insulating layer 35.

Figure 19:
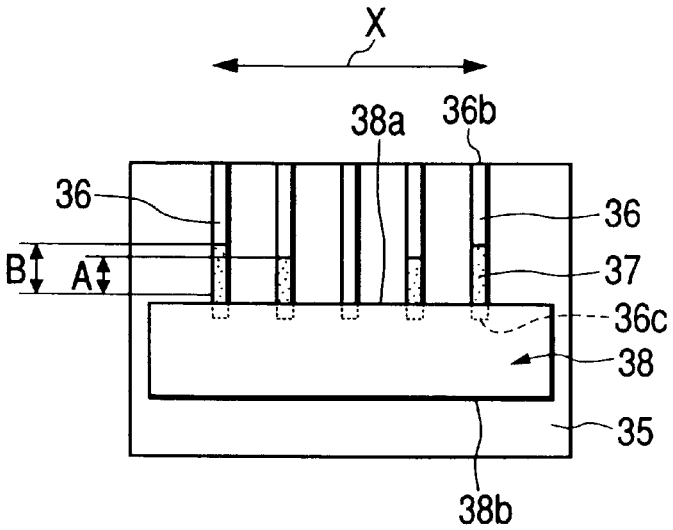
FIG. 19 is a schematic drawing for explaining the method of manufacturing the thermal head according to the invention.
Figure 20:
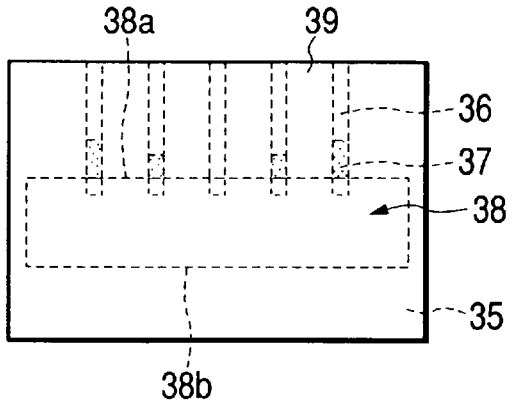
FIG. 20 is a schematic drawing for explaining the method of manufacturing the thermal head according to the invention.

As for the conductive layer 36, as shown in FIG. 19, in the conductive layer 36 on the side of the end in a direction shown by an arrow X, a pair of good conductors 36*b* and 36*c* mutually opposite with each clearance 36*a* having predetermined dimensions A and B between the pair of good conductors are formed.

The clearance 36*a* is formed by etching and others so that the length is longer from the vicinity of the center of the columns of the conductive layers to the conductive layer 36 on the side of the end. That is, relationship between the dimensions A and B of the clearance is A<B.

The pair of good conductors 36*b* and 36*c* are made of high melting point metal not melted and not damaged by the exoergic temperature of the heat element 40, for example high melting point metal having the melting point of 1500° C. or higher such as Cr, Mo, Ti, Zr, Ta, Nb, W and Hf so that the thickness is approximately 0.15 μm for example and the pair of good conductors have uniform thickness.

In the clearance 36*a* between the pair of good conductors 36*b* and 36*c*, a resistor 37 made of Ta—$SiO_2$ which is the same material as that of the heater element 40 for example is provided, the pair of good conductors 36*b* and 36*c* are electrically connected via the resistor 37 and the conductive layer 36 on the side of the end of the columns is composed.

Also, the conductive layer 36 in the vicinity of the center of the columns has no clearance 36*a*, the whole is formed by the same material as that of the pair of good conductors 36*b* and 36*c* and the whole length is formed so that it is equal to the length of the conductive layer 36 on the side of the end of the columns having the clearance 36*a*.

The conductive layer 36 in the vicinity of the center of the columns and the resistor 37 formed in the conductive layer 36 on the side of the end are formed so that they have the same thickness as that of the pair of good conductors 36*b* and 36*c*, for example approximately 0.15 μm so as to reduce an effect upon a temperature dependence characteristic.

That is, each conductive layer 36 on the side of the end of the columns is composed the pair of good conductors 36*b* and 36*c* mutually opposite with the clearance 36*a* having a predetermined dimension between them and the resistor 37 formed in the clearance 36*a* and the resistance value of the conductive layer 36 on the side of the end is increased by differentiating the length of the clearance 36*a*, compared with that of the conductive layer 36 in the vicinity of the center of the columns.

Therefore, when the heater element 40 is energized, voltage drop (common drop) in the conductive layer 36 is corrected and voltage drop in the conductive layer 36 can be removed.

In the thermal head 31 according to the invention, voltage drop in the conductive layer 36 is corrected, the heater element 40 is heated at uniform temperature and a high quality of printed image free of unevenness in printing density can be acquired.

Figure 21:
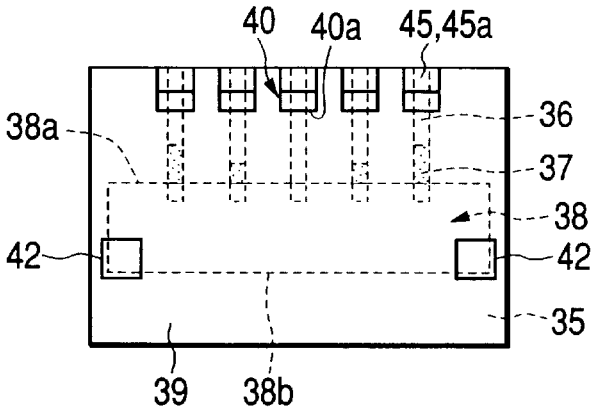
FIG. 21 is a schematic drawing for explaining the method of manufacturing the thermal head according to the invention.

As shown in FIG. 15, a base electrode layer 38 connected to the other end of the conductive layer 36 on the left side is formed on the heat insulating layer 35, is located in a low part as shown in FIG. 21, the shape is rectangular, is provided with a linear front edge 38*a* and a rear edge 38*b*, the front edge 38*a* is laminated on the other end of the conductive layer 36, and the conductive layer 36 and the base electrode layer 38 are electrically connected.

Also, the linear edge 38*a* of the base electrode layer 38 is provided opposite to the respective edges 40*a* of the plural heater elements 40 in a direction of the surface of the substrate which is a horizontal direction via the layer insulating layer 39 as shown in FIG. 21.

The base electrode layer 38 is made of metal having low resistivity and it is desirable that the base electrode layer is made of metal having the resistivity of $1\times10^{-7}$ Ωm or lower such as Al, Cu, Au and Ni so that the thickness is approximately 1.0 to 3.0 μm and is thicker than that of the conductive layer 36.

Such a base electrode layer 38 is formed up to a terminal connection 42 formed on the layer insulating layer 39 near to the end face on the right and left both sides of the substrate 34 in a lateral direction in FIG. 21 and is connected to a common electrode terminal 44 via a side electrode 43 described later.

The layer insulating layer 39 is formed on the upper surface of the conductive layer 36 and the base electrode layer 38. The layer insulating layer 39 is made of the oxide of Si or nitrogen oxide so that the thickness is approximately 1.5 μm so as to secure insulation among the conductive layer 36 under it, the heater element 40 on it and the separate electrode 46.

The heater elements 40 made of Ta—$SiO_2$ are arrayed in the direction shown by the arrow X which is the direction of the row as shown in FIG. 14 and are laminated in a position corresponding to over the convex portion 34*a* on the upper surface of the layer insulating layer 39. One side of the heater element 40 is electrically connected to the connecting electrode 45 and the other side is electrically connected to the separate electrode 46 via a connecting electrode on the separate electrode side 47 as shown in FIG. 15 according to the number of dots corresponding to the desired resolution and the size of the thermal head 1.

Also, the connecting electrode 45 is made of the same material as the conductive layer 36 or the similar material, as shown in FIG. 15, the lower side is connected to one end of the lower conductive layer 36, the upper side is connected to one of the upper heater element 40, and the conductive layer 36 and the heater element 40 with the layer insulating layer 39 between them are electrically connected via the connecting electrode 45.

The connecting electrode 45 is formed in a range in a lateral direction in FIG. 21 having a dimension to which the heater element 40 formed in a position at both ends of the row can be connected.

Further, the terminal connection 42 which is a square hole for forming the side electrode 43 described later connected to the base electrode layer 38 is formed on the layer insulating layer 39 at the right and left ends of the base electrode layer 38 shown in FIG. 21.

The terminal connection 42 is provided on the right and left outsides of the parallel plural separate electrodes 46 formed on the layer insulating layer 39 and as shown in FIG. 16, the side electrode 43 made of metal satisfactory in conductivity such as Al is formed on the base electrode layer 38 inside the terminal connection 42.

The side electrode 43 is pulled out on the side of the left end on the layer insulating layer 39 as shown in FIG. 16 and the part is equivalent to the common electrode terminal 44. Conductive plating is applied on the common electrode terminal 44, a terminal plating layer 44*a* is formed and is exposed from an upper passivation layer 49 described later.

Therefore, the base electrode layer 38 and the common electrode terminal 44 are electrically connected via the side electrode 43.

The separate electrodes 46 are formed on the upper surface of the layer insulating layer 39 and are arrayed in parallel in the same direction as the conductive layers 36 in a range from the vicinity of the left end of the heater element 40 in the drawing on the right side in FIG. 15 to the left end of the substrate 34. The separate electrode 46 is made of metal satisfactory in conductivity such as Al and Cu.

The separate electrode 46 is electrically connected to the heater element 10 via the connecting electrode on the separate electrode side 47 made of high melting point metal such as Mo, Cr and Ti and formed on the other side of the heater element 40.

Further, the separate electrode 46 is pulled out at the left end shown in FIG. 15 and the left end is equivalent to the separate electrode terminal 48. Conductive plating is applied on the separate electrode terminal 48, a terminal plating layer 48*a* is formed and the surface of the terminal plating layer 48*a* is exposed from the passivation layer 49.

The passivation layer 49 for protecting the heater element 40, the separate electrode 46, the connecting electrode 45, the connecting electrode on the separate electrode side 47, the layer insulating layer 39, the side electrode 43, the conductive layer 36, the base electrode layer 38 and the heat insulating layer 35 from oxidation or abrasion and others is formed on/over them as shown in FIG. 15. The passivation layer 49 is made of SIALON (Si—Al—O—N compound solid solution) or Si—O—N compound satisfactory in oxidation resistance and abrasion resistance and others.

Next, referring to FIGS. 17 to 21, a method of manufacturing a thermal head 31 equivalent to another embodiment of the invention will be described.

For the method of manufacturing the thermal head according to the invention, as heretofore, plural thermal heads 31 are simultaneously formed on one large substrate 34 not shown and plural thermal heads 31 are simultaneously acquired by dividing the large substrate 34 into desired size.

Figure 17:
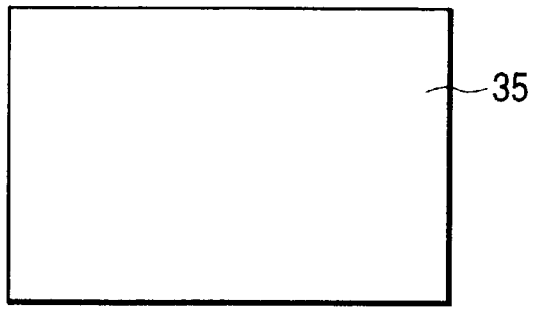
FIG. 17 is a schematic drawing for explaining a method of manufacturing the thermal head according to the invention.

In the method of manufacturing such a thermal head 31, first in a process for forming a substrate, silicon formed flatly is etched as heretofore, the substrate 34 having a convex portion 34*a* is formed and next, in a process for forming a heat insulating layer, a heat insulating layer 35 having substantially even thickness shown in FIG. 17 and made of the oxide of silicon, transition metal and oxygen is formed on the upper surface of the substrate 34 as heretofore.

Figure 18:
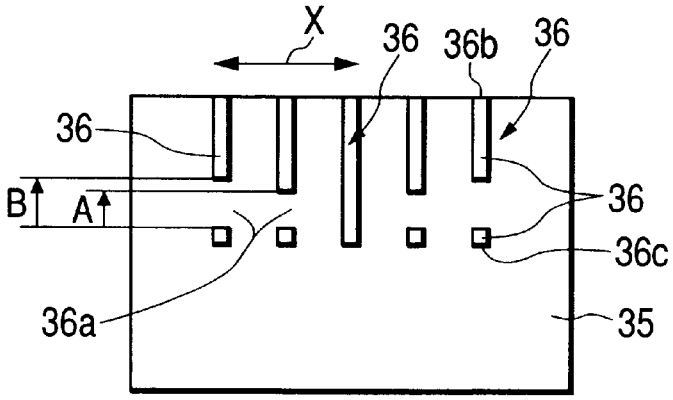
FIG. 18 is a schematic drawing for explaining the method of manufacturing the thermal head according to the invention.

Next, in a process for forming a conductive layer, after high melting point metal having the melting point of 1500° C. or higher such as Cr, Mo, Ti, Zr, Ta, No, W and Hf is deposited on the supper surface of the heat insulating layer 35 by sputtering and others so that the metal has the uniform thickness of approximately 0.15 $\mu$m, plural conductive layers 36 in a desired pattern arrayed in parallel as shown in FIG. 18 are formed by etching.

At this time, the conductive layer 36 located at the end of the columns is composed of a pair of good conductors 36*b* and 36*c* mutually opposite with each clearance 36*a* respectively having a predetermined dimension A and B between them and the resistor 37 made of Ta—$SiO_2$ which is the same material as that of the heater element 40 for example is formed in the clearance 36*a* by sputtering and etching. The clearance 36*a* is elongated from the vicinity of the center of the columns to the conductive layer 36 located at the end.

The resistor 37 made of Ta—$SiO_2$ which is the same material as that of the heater element 40 for example is formed in each clearance 36*a* by sputtering and etching and the pair of good conductors 36*b* and 36*c* mutually opposite are connected.

Next, in a process for forming a base electrode layer, as shown in FIG. 19, a base electrode layer 38 is formed on the heat insulating layer 35 and on the other end of the conductive layer 36. As for the base electrode layer 38, after metal satisfactory in conductivity having the resistivity of $1\times10^{-7}$ Ωm or lower such as Al, Cu, Au and Ni is uniformly deposited by sputtering and others so that the metal has the thickness of approximately 1 to 3 $\mu$m, the shape having a front edge 38*a* and a rear edge 38*b* is formed rectangularly by etching and the right and left both ends in a lateral direction are elongated up to the vicinity of the end of the substrate 34.

Next, in a process for forming a layer insulating layer, a layer insulating layer 39 is formed so that the layer covers each upper surface of the heat insulating layer 35, the conductive layer 36 and the base electrode layer 38.

The layer insulating layer 39 is formed by depositing material such as $SiO_2$ or Si—O—N compound on the overall upper surface of the conductive layer 36 and the base electrode layer 38 by sputtering or CVD and others so that the material has the uniform thickness of approximately 1 to 3 $\mu$m.

Next, in an etching process in the process for forming the layer insulating layer, after photoresist is applied on the overall upper surface of the layer insulating layer 39 by a spinner and others and a resist film is formed, the layer insulating layer 39 in the upper part shown in FIG. 21 is etched by buffered hydrofluoric acid (BHF) and others, one end of the conductive layer 36 is exposed, a connection on the common electrode side 35*a* is formed, a terminal connection 42 which is a square hole is formed at the right and left both ends of the base electrode layer 38 and a part of the base electrode layer 38 is exposed.

Next, in a process for forming a heater element, as heretofore, after a desired heating resistor made of $Ta_2$ N or Ta—$SiO_2$ is formed by sputtering and others so that the resistor has the uniform thickness of approximately 0.3 $\mu$m, etching by photolithography is applied and plural heater elements 40 in a predetermined shape arrayed in a row according to the desired number of dots corresponding to resolution are laminated on the layer insulating layer 39.

At this time, each heater element 40 is insulated from the conductive layer 36 by the layer insulating layer 39.

Next, in a process for forming a common electrode, a connecting electrode 45 shown in the upper part in FIG. 21 is formed. The connecting electrode 45 is formed in a desired shape for electrically connecting one side of the heater element 40 and one end of the conductive layer 36 exposed by a connection on the common electrode side 45*a* by etching and others by depositing the same material as that of the conductive layer 36 by sputtering and others.

Next, in a process for forming a connecting electrode on the separate electrode side, high melting point metal which is the same material as that of the connecting electrode 45 is deposited on the other side of the heater element 40 and on the layer insulating layer 39 in the vicinity by sputtering and others and a connecting electrode on the separate electrode side 47 in a desired pattern for electrically connecting the heater element 40 and a separate electrode 46 formed in a process for forming a separate electrode described later is formed by etching and others.

Next, in a process for forming the separate electrode, separate electrodes 46 arrayed in parallel are formed. As for the separate electrode 46, Al is deposited on the layer insulating layer 39 by sputtering and others so that it has the thickness of approximately 1 to 3 $\mu$m for example, is connected to each heater element 40 via the connecting electrode on the separate electrode side 47 and can independently energize the heater element 40.

Next, in a process for forming a side electrode, after metal having satisfactory conductivity such as Al is deposited by sputtering and others so that the metal has the uniform thickness of approximately 1 to 3 μm for example, a side electrode 43 in a desired pattern electrically connected to the base electrode layer 38 is formed by etching inside the terminal connection 42.

Next, in a process for forming a passivation layer, a passivation layer 49 is formed by depositing material such as SIALON (Si—Al—O—N compound solid solution) or Si—O—N compound on the overall surface except the common electrode terminal 44 and the separate electrode terminal 48 by sputtering, CVD and others so that the material has the substantially even thickness of approximately 5 to 10 μm for example and next, in a dicing process, the manufacture of the thermal head 31 equivalent to this embodiment is completed by dividing the large substrate 34 in desired positions and simultaneously acquiring chipped plural thermal heads 31.

When the passivation layer 49 is formed, a mask layer such as a heat-resistant pressure sensitive adhesive tape is applied to the common electrode terminal 44 and the separate electrode terminal 48, and the common electrode terminal 44 and the separate electrode terminal 48 are exposed by peeling the mask layer after the passivation layer 49 is formed.

Terminal plating layers 44*a* and 48*a* easy in solderability such as Ni—Sn compound are respectively formed on the upper surface of the common electrode terminal 44 and the separate electrode terminal 48.

In the description of the embodiment of the invention, the conductive layer 36 in the vicinity of the center of the columns without clearance 36*a* and a resistor 37 is described, however, clearance 36*a* is provided to the conductive layer 36 in the vicinity of the center of the columns and a resistor 37 may be also formed in the clearance 36*a*.

Next, to explain action in the embodiment of the invention using the thermal printer as an example, the thermal head 31 having the configuration described above and equivalent to another embodiment of the invention is mounted on a carriage of the thermal printer not shown.

That is, the thermal head 31 according to the invention presses an ink ribbon of a ribbon cassette installed on the carriage on recording paper, melts and transfers or sublimates and transfers ink of the ink ribbon on the heater element 40 on the recording paper by selectively energizing the heater elements 40 based upon record information, moving the carriage and executes desired image printing.

To explain further concretely, one end of a cable for energizing not shown is connected to the separate electrode terminal 48 and the common electrode terminal 44 of the thermal head 31 equivalent to the embodiment of the invention and the other end of the cable is connected to an energizing controller not shown in the body of the printer. The energizing controller supplies slightly higher voltage current than that in a conventional type to the separate electrode terminal 48 based upon record information via the cable.

Hereby, first, a signal is respectively transmitted to the separate electrodes 46 via the separate electrode terminal 48, the heater elements 40 are energized and are selectively heated at predetermined temperature based upon the record information.

Current respectively flows to the conductive layer 36 under the heater element 40 from the heater element 40 via the connecting electrode 45.

Next, current flows from the conductive layer 36 to the base electrode layer 38. At this time, as the conductive layer 36 is thinned up to approximately 0.15 μm though the conductive layer 36 is located immediately under the heater element 40, an effect upon a temperature dependence characteristic is small and also, as the conductive layer is made of high melting point metal, energizing is not prevented by the heat of the heater element 40.

Next, current flows from the base electrode layer 38 to the common electrode terminal 44 via the side electrode 43 and current flows from the common electrode terminal 44 to the side outside the thermal head 31 of the printer.

As described above, as control current according to an instruction from the energizing controller on the side of the printer flows from the separate electrode terminal 48 to the common electrode terminal 44 via the heater element 40, Joule heat is generated in the heater element 40 and the heater element is heated up to predetermined temperature.

As described above, as the resistance value of the conductive layer 36 on the side of the end of the columns is increased even if voltage drop occurs in the conductive layer 36 connected to the heater element 40 in the vicinity of the center of the columns located in a far position from the right and left two common electrode terminals 44 because in the thermal head 31 according to the invention, the resistance value of the conductive layer 36 on the side of the end is increased, compared with that of the conductive layer 36 formed in parallel and located in the vicinity of the center of the columns, the drop of voltage applied to the conductive layer 36 on the side of the end can be also equalized to the drop of voltage applied to the conductive layer 36 in the vicinity of the center and voltage applied to each conductive layer 36 in the vicinity of the center of the columns and on the side of the end can be corrected so that the voltage is substantially equal.

Therefore, the heater elements 40 can be uniformly energized and voltage drop in the common electrode which has been a problem heretofore can be inhibited.

In such a thermal head 31 according to the invention, the exoergic temperature of the heater element 40 in the vicinity of the center of the columns never lowers as heretofore, the heater element 40 can be heated at uniform temperature and in printing by a thermal printer for example, a satisfactory printed image free of unevenness in printing density can be acquired.

Also, in a thermal head 61 equivalent to further another embodiment of the invention, as shown in FIG. 22, plural groups E and F of good conductors each of which is composed of adjacent plural good conductors 66*b* and 66*c* having a slit between them and which are located at the end of the columns are formed.

The group G of good conductors composed of plural conductive layers 66 having a slit between them without clearance 66*a* the whole of which is formed by the same material as the good conductors 66*b* and 66*c* is formed in the vicinity of the center of the columns.

The adjacent plural good conductors 66*b* and 66*c* in the groups E and F of good conductors located on the side of the end are mutually connected via a resistor 67.

Also, plural groups E and F of good conductors are formed on the side of the end from the vicinity of the center of the columns, the length of the clearance 66*a* between mutually opposite good conductors 66*b* and 66*c* in the respective groups E and F of good conductors is equalized and the clearance 66*a* in the respective groups E and F of good conductors is formed so that it is longer from the vicinity of the center of the columns to the groups E and F of good conductors located on the side of the end.

That is, relationship between the dimensions C and D of the clearance 66*a* is C<D. Therefore, the resistance value of the group of good conductors E on the side of the end having the clearance 66*a* in the dimension D is made larger than that of the group of good conductors F in the vicinity of the center having the clearance 66*a* in the dimension C.

Also, in a transformed example of further another embodiment of the invention, the good conductors 66*b* and 66*c* in the groups of good conductors E and F and the good conductors 66 in the group of good conductors G which have a slit between them in the embodiment described above have no slit between them and good conductors may be also integrated every group E, F and G.

Such a thermal head 61 equivalent to further another embodiment can be easily manufactured because the resistor 67 is not required to be formed every conductor 66.

Also, in a thermal head 71 equivalent to another embodiment of the invention, as shown in FIG. 23, a conductor layer 76 located at the end of columns is composed of a narrow part 76*a* and a wide part 76*b* respectively different in the dimension of the width.

The resistance value of the conductive layer 76 is increased from the conductive layer 76 in the vicinity of the center of the columns to the conductive layer 76 on the side of the end by differentiating the length of the narrow part 76*a* from dimensions J and K.

The narrow part 76*a* of such a conductive layer 76 is elongated from the vicinity of the center of the columns to the conductive layer 76 located on the side of the end.

In such a thermal head 71, the resistor made of material different from that of the conductive layer is not required as in another embodiment and the manufacture is easy.

What is claimed is:

1. A thermal head, comprising:

a heat insulating layer formed on an upper surface of a substrate;

plural heater elements formed in a row over the heat insulating layer;

plural separate electrodes uniquely electrically connected to one of the plural heater elements; and a common electrode, wherein:

the common electrode is comprised of a base electrode layer connected to a common electrode terminal provided on both outsides of columns of the separate electrodes and a conductive layer connected to the base electrode layer and formed on a side of the row of heater elements;

the common electrode is formed on most of a surface of the heat insulating layer;

a layer insulating layer to electrically insulate the common electrode and the separate electrodes is formed on the common electrode;

the separate electrodes and the row of heater elements are formed on the layer insulating layer; and an edge of the base electrode layer is provided opposite to an edge of the row of heater elements in a direction of the surface of the substrate and the edge of the base electrode layer is protruded in one of a triangle and an arc.

2. A thermal head according to claim 1, wherein:

the edge of the base electrode layer opposed to the row of heater elements is linearly formed in parallel to a direction of the row of the heater elements.

3. A thermal head according to claim 1, wherein:

the edge of the base electrode layer opposed to the row of heater elements is disposed close to the side of the row of heater elements in approximately a center of the row of the heater elements.

4. A thermal head, comprising:

a heat insulating layer formed on an upper surface of a substrate;

plural heater elements formed in a row over the heat insulating layer;

plural separate electrodes uniquely electrically connected to one of the row of heater elements;

a common electrode having a base electrode layer connected to a common electrode terminal provided on both outsides of columns of the separate electrodes and a conductive layer connected to the base electrode layer and formed on a side of the row of heater elements, the common electrode formed on most of the surface of the heat insulating layer; and a layer insulating layer to electrically insulate the common electrode from the separate electrodes formed on the common electrode, the separate electrodes and the row of heater elements formed on the layer insulating layer, wherein an edge of the base electrode layer is provided opposite to an edge of the row of heater elements in a direction of the surface of the substrate, and the edge of the base electrode layer opposed to the row of heater elements is disposed far from the row of heater elements in approximately a center of the row of the heater elements.

5. A thermal head according to claim 4, wherein:

the edge of the base electrode layer is made hollow in one of a triangle and an arc.

6. A thermal head, comprising:

a heat insulating layer formed on an upper surface of a substrate;

plural heater elements formed in a row over the heat insulating layer; and plural separate electrodes electrically connected to one of the row of heater elements, wherein:

plural conductive layers formed in parallel in a same direction as the separate electrodes are provided on an upper surface of the heat insulating layer under the separate electrodes;

a layer insulating layer to insulate the conductive layer from the separate electrodes is provided between the separate electrodes and the conductive layers;

the conductive layers are formed such that resistance values of side conductive layers of the conductive layers are larger than that of a conductive layer in approximately a center of the conductive layers;

a base electrode layer and the heater elements are uniquely electrically connected to one of the conductive layers; and the heater elements are energized.

7. A thermal head according to claim 6, wherein:

the side conductive layers are each comprised of a pair of good conductors mutually opposite with a clearance of a predetermined dimension therebetween and a resistor formed in the clearance; and resistance values of the side conductive layers are increased, compared with that of the center conductive layer, by differentiating a length of the clearance.

8. A thermal head according to claim 7, wherein:

the clearances are increasingly elongated from the center conductive layer to a conductive layer farthest from the center conductive layer.

9. A thermal head according to claim 7, wherein:

the conductive layers are each provided with plural groups of good conductors, each group of good conductors is comprised of adjacent plural good conductors; and the adjacent plural good conductors in each group of good conductors of the side conductive layers are comprised of one of the pairs of good conductors and are connected with one another via the resistor in each of the adjacent plural good conductors.

10. A thermal head according to claim 9, wherein:

the length of the clearance between the pair of good conductors in each adjacent plural good conductor is equalized in each group of good conductors; and the clearances of each group of good conductors are increasingly elongated from the center conductive layer to a conductive layer farthest from the center conductive layer.

11. A thermal head according to claim 6, wherein:

each side conductive layer is comprised of a narrow part and a wide part; and the resistance value of each side conductive layer is increased, compared with that of the center conductive layer, by differentiating a length of the narrow part.

12. A thermal head according to claim 11, wherein:

the narrow parts of the side conductive layers are increasingly elongated from the center conductive layer to a conductive layer farthest from the center conductive layer.

* * * * *